United States Patent [19]

Gendron et al.

[11] 4,126,191

[45] Nov. 21, 1978

[54] GAS DISCHARGE TYPE UNDERWATER HAMMER WITH LIQUID PURGE AND REFLOOD CONTROL

[75] Inventors: George J. Gendron; Henry A. Nelson Holland, both of Houston, Tex.

[73] Assignee: Raymond International Inc., Houston, Tex.

[21] Appl. No.: 803,302

[22] Filed: Jun. 3, 1977

[51] Int. Cl.[2] ..... B25D 9/00

[52] U.S. Cl. ..... 173/1; 173/127; 173/135; 173/DIG. 1; 405/228

[58] Field of Search ..... 61/53.5; 173/1, 126–128, 173/134–138, DIG. 1

[56] References Cited

U.S. PATENT DOCUMENTS

| | | | |
|---|---|---|---|
| 1,891,411 | 12/1932 | Greve | 173/135 X |
| 2,904,964 | 9/1959 | Kupka | 173/DIG. 1 X |
| 3,431,986 | 3/1969 | Jansz | 173/134 |
| 3,604,519 | 9/1971 | Chelminski | 173/1 |
| 3,646,598 | 2/1972 | Chelminski | 61/53.5 |
| 3,714,789 | 2/1973 | Chelminski | 173/1 X |
| 3,721,095 | 3/1973 | Chelminski | 173/1 X |
| 3,765,184 | 10/1973 | Menard | 61/53.5 X |
| 3,788,402 | 1/1974 | Chelminski | 173/135 X |
| 3,800,548 | 4/1974 | Wisotsky | 173/1 X |
| 3,817,335 | 6/1974 | Chelminski | 173/127 |
| 3,820,346 | 6/1974 | Wisotsky | 173/1 X |
| 3,828,866 | 8/1974 | Jansz | 173/1 X |
| 3,878,902 | 4/1975 | Matsuo | 173/14 |
| 3,881,557 | 5/1975 | Gendron et al. | 173/DIG. 1 X |
| 3,892,279 | 7/1975 | Amtsberg | 173/134 X |
| 3,958,647 | 5/1976 | Chelminski | 173/135 X |
| 4,060,139 | 11/1977 | Adair | 173/DIG. 1 X |

FOREIGN PATENT DOCUMENTS

| | | | |
|---|---|---|---|
| 2,243,309 | 3/1973 | Fed. Rep. of Germany | 173/DIG. 1 |

*Primary Examiner*—Lawrence J. Staab

*Attorney, Agent, or Firm*—Fitzpatrick, Cella, Harper & Scinto

[57] ABSTRACT

An underwater hammer, of the gas discharge type, is provided with a surrounding casing arranged in the nature of a diving bell from which liquid can be purged so that the hammer ram may move up and down with minimum resistance. A reflood tube extends down through the upper end of the casing and opens into an axial reflood passageway in the ram and liquid is pumped through this tube to obtain reflooding after each cycle of operation.

15 Claims, 10 Drawing Figures

Fig. 1.
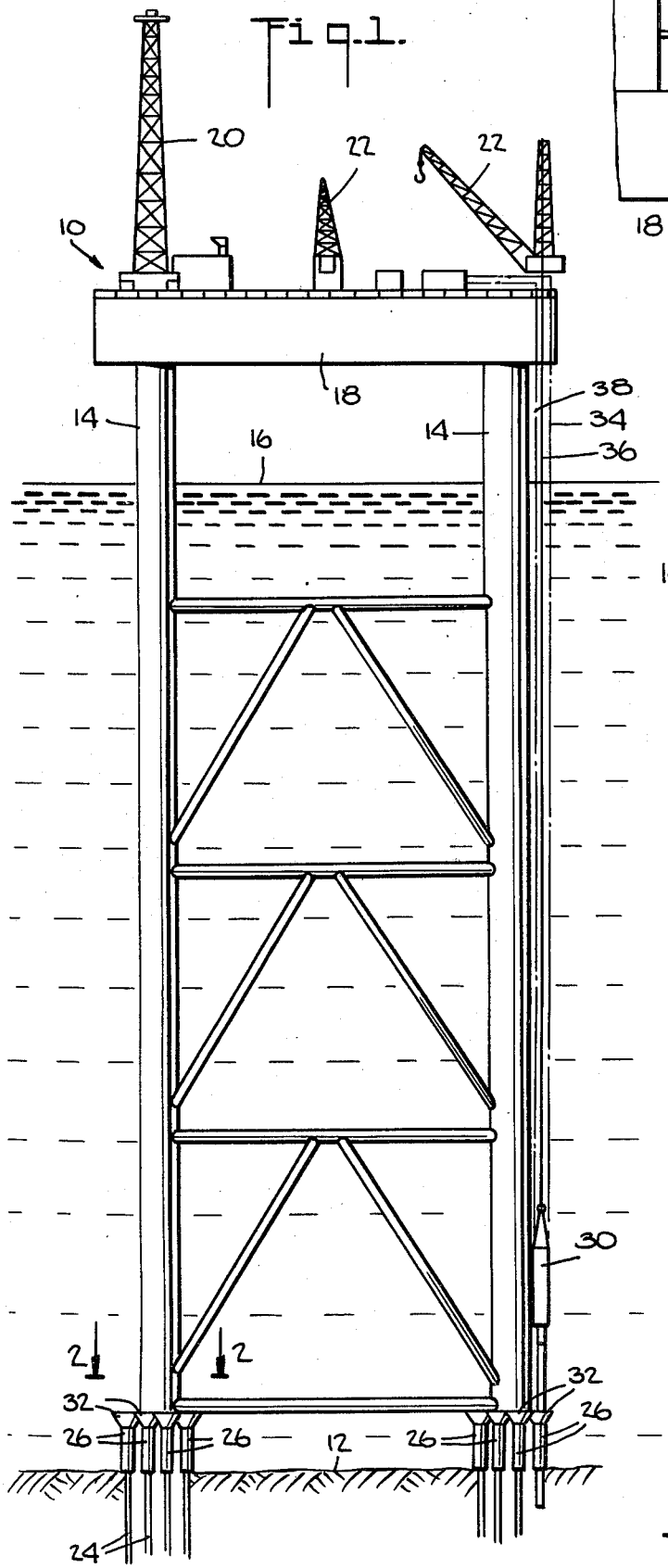
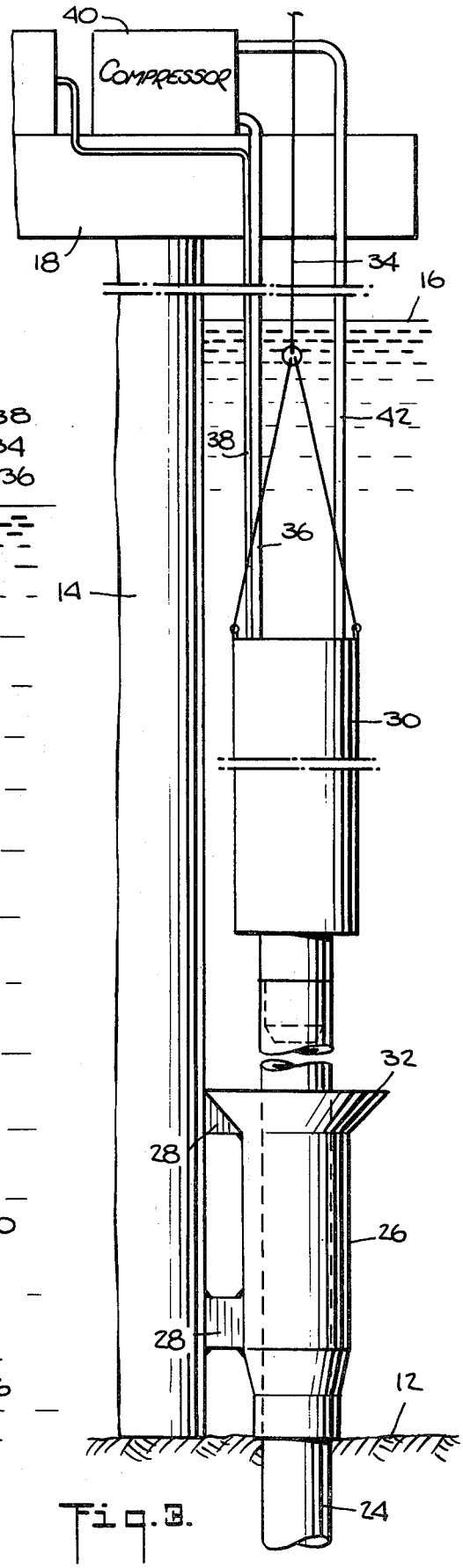
Fig. 3.

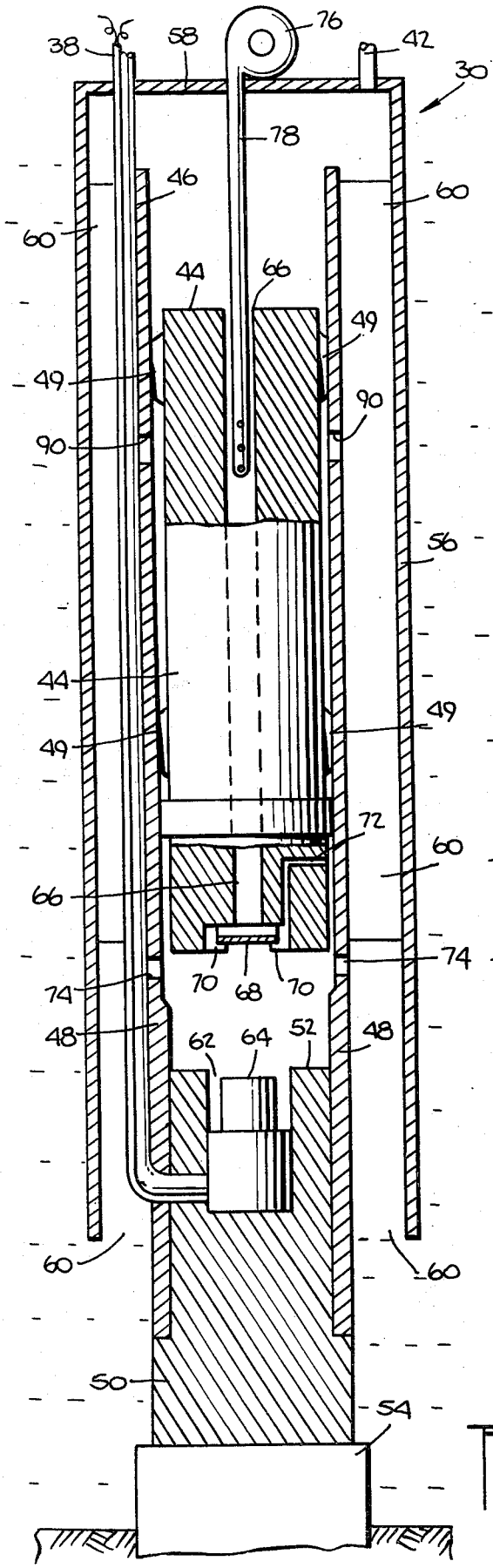
Fig. 9.
Fig. 10.
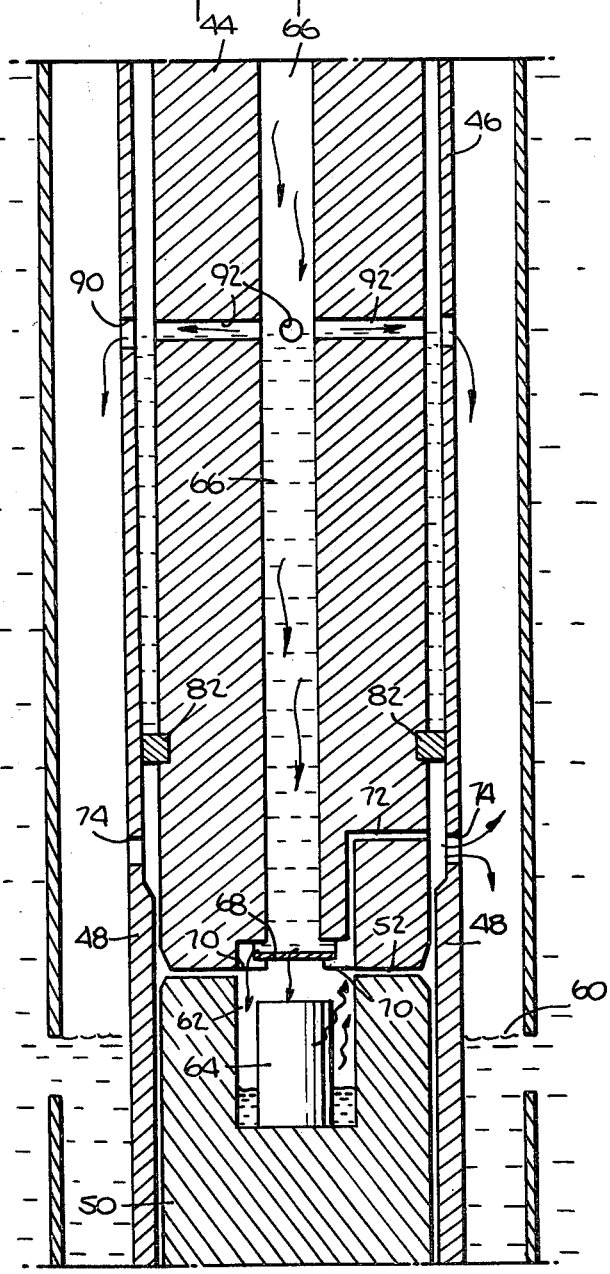

GAS DISCHARGE TYPE UNDERWATER HAMMER WITH LIQUID PURGE AND REFLOOD CONTROL

BACKGROUND OF THE INVENTION

1. Field of the Invention

This invention relates to gas discharge type pile driving hammers which can operate under water and in particular it concerns improvements providing control of liquid purge and reflooding in such hammers for improving the efficiency thereof.

2. Description of the Prior Art

Prior art gas discharge type underwater hammers are shown and described in U.S. Pat. No. 3,958,647 to Stephen V. Chelminski. Other patents in this field are U.S. Pat. Nos. 3,604,519; 3,646,598; 3,714,789; 3,721,095; 3,788,402; 3,817,335 and 3,892,279. In addition, there are two pending U.S. patent applications known to applicant which relate to gas discharge type underwater hammers. These are application Ser. No. 745,637 filed Nov. 29, 1976 and now U.S. Pat. No. 4,060,139 in the name of Harold Lee Adair and application Ser. No. 763,085 filed Jan. 27, 1977 in the name of George J. Gendron and Henry A. Nelson Holland, both of which applications are assigned to the assignee of the present invention.

In general, a gas discharge type underwater hammer comprises an elongated guide tube, a massive ram that is driven up and down in the tube, an anvil in the tube which is hammered upon by the ram and a gas discharge device positioned between the ram and the anvil. When the gas discharge device is triggered, it releases a charge of highly compressed gas which drives the ram upwardly in the guide tube. When the pressure of the gas dissipates and the ram loses its upward momentum it falls back onto the anvil; and the striking force of the ram on the anvil drives the pile, or other element on which the anvil is mounted, downwardly. The gas which is used to drive the ram upwardly in the guide tube is exhausted from the hammer during each cycle through an annular clearance between the ram and the guide tube; and the region under the ram is reflooded prior to the next gas discharge by a flow of water down through a central passageway in the ram. In one prior art gas discharge type hammer a gas reservoir is arranged to be placed into communication with the interior of the ram guide tube under the ram after the ram has been driven upwardly. The space between the ram and guide tube above the region of communication is essentially sealed to prevent passage of the gas which is used to drive the ram upwardly in the guide tube. This gas then exhausts into the reservoir and is thereby prevented from aerating the incoming water which refloods the region under the ram.

SUMMARY OF THE INVENTION

According to one aspect of the present invention, there is provided a gas discharge type underwater hammer with liquid purging which avoids the necessity of driving the hammer ram upwardly through surrounding water, and which, at the same time prevents the formation of a vacuum under the upwardly moving ram which otherwise might draw water in on top of the anvil and undesirably cushion the hammer blow. By eliminating water from around the ram, viscous drag is reduced and more of the gas discharge energy becomes directed into the ram so that a higher stroke and therefore a greater impact is delivered for a given amount of gas discharge energy. The elimination of water from around the ram is achieved, according to this invention, by providing a guide tube which contains a hammer ram and by positioning the guide tube and ram inside an outer casing which is closed at the top and open at the bottom in the manner of a diving bell. In addition, ports are provided in the guide tube to become uncovered from the ram during its upward flight so that the released gas and accompanying water can be ejected from the guide tube into the outer casing. The guide tube is also constructed to provide open communication with the outer casing above the ram. This allows gas, which is pushed upwardly above the ram during its upward flight, to recirculate down along the sides of the outer casing and back under the ram to prevent the formation of a vacuum which otherwise might draw water in under the ram and cushion its blow. An anvil is located at the bottom of the guide tube in the path of the descending ram to receive its impact. A gas discharge device is provided in a cavity formed by and between the ram and anvil and this gas discharge device is triggered to release a sudden burst of pressurized gas under the ram to drive it upwardly in the guide tube.

According to a further aspect of the invention there are provided novel arrangements for controlled reflooding the cavity which contains the gas discharge device following each stroke of the ram. The purpose for this is to obtain an efficient transfer of energy from the pressurized gas to the ram itself. If air or any other gas is trapped in the cavity, or if aerated liquid is present, a substantial amount of energy from the pressurized gas will be dissipated in compressing the trapped air or gas, and therefore will not be available for driving the ram.

The novel reflooding arrangements of the present invention comprise a reflood tube which extends down and opens inside a longitudinal passageway formed in the ram and leading from its upper end to the gas discharge device cavity. The reflood tube extends up through the top of the outer casing and is connected to a pump which forces water from outside the casing down through the tube and into the longitudinal passage in the ram and into the gas discharge device cavity. The pump may be located either above the water surface or on top of the hammer casing itself. This arrangement allows the ram to move up and down while the reflood tube remains stationary.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other arrangements for carrying out the several purposes of the invention. It is important, therefore, that this disclosure be regarded as including such equivalent arrangements as do not depart from the spirit and scope of the invention.

BRIEF DESCRIPTION OF THE DRAWINGS

Selected embodiments of the invention have been chosen for purposes of illustration and description, and are shown in the accompanying drawings, forming a part of the specification, wherein:

FIG. 1 is an elevational view of an offshore tower in which a novel pile driving hammer of the present invention is used;

FIG. 5 is a cross section view taken along line 5—5 of FIG. 4;

FIG. 9 is an enlarged elevational view, shown in section, of a first modification of the hammer of the present invention; and FIG. 10 is a fragmentary sectional view of a further modification of the hammer of the present invention.

DETAILED DESCRIPTION OF THE PREFERRED EMBODIMENTS

Figure 3:
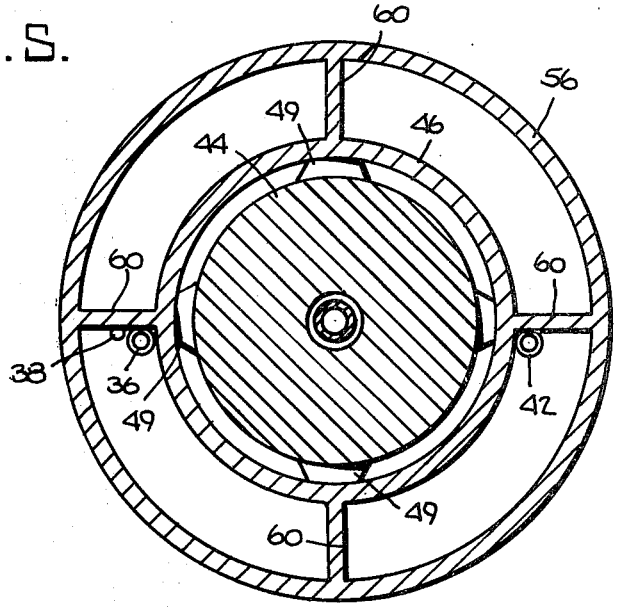
FIG. 3 is an enlarged fragmentary view showing the positional arrangement of the hammer in FIG. 1 with respect to a pile being driven.

The present invention has application to various types of underwater hammering operations. FIG. 1 illustrates the application of the invention to the driving of anchor piles for securing an offshore tower to a sea bed such as the ocean floor. As shown in FIG. 1, an offshore tower 10 rests on a sea bed 12 and its legs 14 extend up from the sea bed past the water surface 16 to support a platform 18 above the action of the sea. The platform supports well drilling equipment such as a drilling rig 20, cranes 22 and various other supplies, equipment and crew living quarters (not shown).

Figure 2:
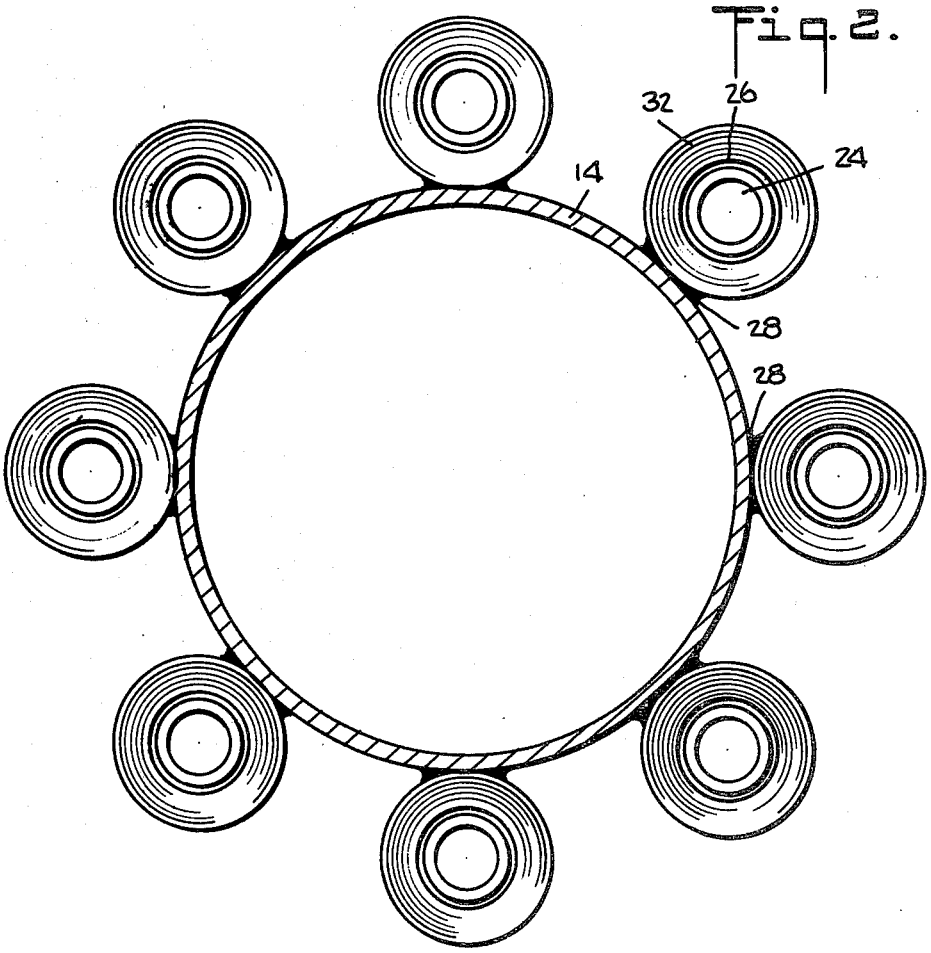
FIG. 2 is an enlarged cross-sectional view taken along line 2—2 of FIG. 1.

A plurality of anchor piles 24 extend downwardly through tubular sleeves 26 at the bottom of the tower legs 14 and into the sea bed 12. As shown in FIGS. 1 and 2 the sleeves 26 are distributed around the tower leg 14; and, as shown in FIG. 3, they are secured to the leg by means of support brackets 28.

The anchor piles 24, as shown in FIGS. 1 and 3, are lowered down from the platform 18 until they enter into their respective sleeves through flared guides 32 at the upper ends of the sleeves. The hammer 30, which is suspended by means of cables 34 extending down from the platform 18, is then lowered down until it rests on top of one of the piles 24. A compressed gas supply conduit 36 and electrical cables 38 also extend down from the platform 18 to the hammer 30. The electrical cables transmit signals from the hammer up to the surface so that the operation of the hammer can be monitored.

When an anchor pile 24 is lowered down through its sleeve 26 and the hammer 30 is placed on top of it, the hammer is put into operation and it drives the anchor pile down into the sea bed 12 to a depth sufficient to enable the pile to resist both downward forces exerted by the weight of the tower 10 and upward forces which may be imposed as a result of winds or water currents pushing laterally against the upper end of the tower. After the pile 24 has been driven to its required depth it is locked to the sleeve as by grouting or by mechanical means, for example by wedge locking means such as shown in copending U.S. patent application Ser. No. 759,028 filed Jan. 13, 1977. After each pile is driven the hammer is withdrawn and moved over to drive another pile down through a different sleeve. After all of the piles 24 have been driven and locked to their respective sleeves 26 the tower 10 will be securely held to the sea bed 12.

The underwater hammer 30, which will be described in detail hereinafter, is powered by compressed gas such as compressed air. A compressor 40 is mounted on the platform 18 and is connected at its high pressure output to the compressed gas supply conduit 36. The compressor 40 may draw in atmospheric air and compress it to operating pressure; or, as shown in FIG. 3, the compressor 40 may be supplied with exhaust air from the hammer 30 via a return conduit 42. This latter arrangement supplies a higher pressure inlet to the compressor 40 than would result if the compressor were to draw on air at ambient pressure.

Figure 4:
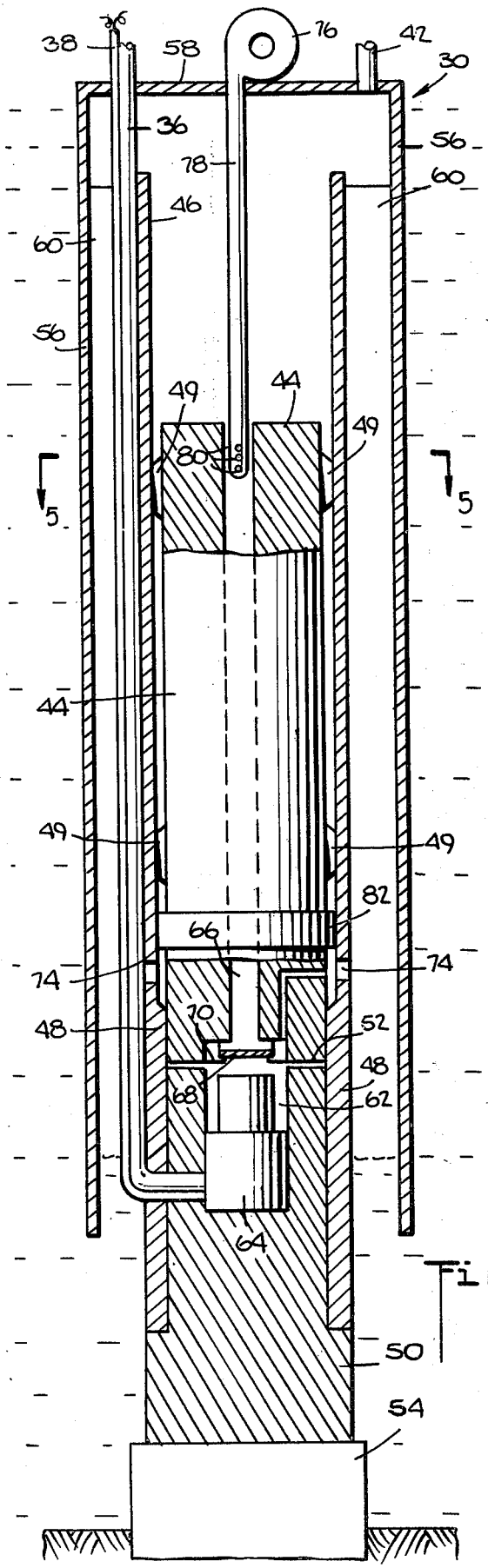
FIG. 4 is an enlarged elevational view, shown in section, of the hammer of FIGS. 1 and 3.

The construction of the hammer 30 itself is best seen in FIGS. 4 and 5. As shown the hammer 30 includes a massive cylindrically shaped ram 44 arranged for free up and down movement in a guide tube 46. The lower end of the guide tube is of smaller inner diameter than the remainder thereof and this forms an acceleration sleeve 48 which fits closely around the lower end of the ram 44 when it is in its lowermost position as shown in FIG. 4. The upper portion of the ram is provided with sliding shoes 49 which guide it in the guide tube 46. An anvil 50 is positioned at the lower end of the guide tube 46 and it fits part way up into the acceleration sleeve 48. The anvil 50 has a impact face 52 which is impacted by the lower end of the ram 44 when it falls downwardly inside the guide tube 46. The anvil transfers the energy of these impacts down to a pile cap block 54 which rests on and drives the pile 30 downwardly.

An outer cylindrical casing 56, which is opened at its lower end and is closed at its upper end by means of a cover plate 58, fits down over the guide tube 46. Spacer ribs 60 (FIG. 8) extend radially between the guide tube 46 and the outer casing 56 to hold the tube centered within the casing. As shown the upper end of the guide tube 46 is located below the cover plate 58 so that the interior of the guide tube above the ram 44 is in open communication with the spaces between the guide tube and outer casing. The open lower end of the outer casing 56 is positioned below the impact face 52 of the anvil 50; and it cooperates with the lower region of the guide tube 46 to define an annular gas outlet opening 60 which is open to the surrounding sea water. The opening 60 is positioned below the level of the impact face 52.

The anvil 50 is formed with a gas discharge device cavity 62 which opens to the impact face 52 and which contains a gas discharge device 64. The cavity 62 is defined by and between the anvil 50 and the ram 44. The details of the gas discharge device form no part of the present invention and therefore they will not be described herein. Suitable such devices are described in detail in U.S. Pat. Nos. 3,310,128; 3,379,273; 3,817,335; 3,892,279 and 3,958,647. The gas discharge device 64 accumulates a charge of gas, such as air, nitrogen, etc. at a very high pressure; and then, when its gas charge reaches a predetermined pressure, the device is automatically triggered and releases its charge into the surrounding cavity 62.

The ram 44 is formed with an axial reflood passageway 66 which opens at the upper and lower ends of the ram. A reflood valve plate 68 is mounted by means of retainer lugs 70 at the bottom of the ram 44 for up and down movement to close and open the lower end of the reflood passageway 66. A reflood vent passageway 72 extends through the lower portion of the ram 44 with its lower end exposed to the cavity 62 and its upper end open at the side of the ram above the guide tube acceleration sleeve 48 when the ram is at rest on the anvil 50 as shown in FIG. 4.

The guide tube 46 is also provided with guide tube ports 74 just above the acceleration sleeve 48. As shown, these ports communicate with the space between the guide tube 46 and the outer casing 56.

A reflood pump 76 is mounted on top of the casing cover plate 58. The outlet of this pump is connected to a reflood tube 78 which extends down through the cover plate 58 and part way into the reflood passageway 66 of the ram 44. The reflood tube 78 is of sufficient length to just enter the top of the reflood passageway when the ram is at rest on the anvil 50 as shown in FIG. 4. A plurality of reflood tube outlet openings 80 are provided along the sides of the reflood tube 78 at its lower end so that water which is pumped down through the tube is directed into the reflood passageway.

The reflood pump 76 is driven continuously and any suitable driving means, such as an electric motor (not shown) may be provided for this purpose. The inlet of the reflood pump 76 is arranged to take in water from the region adjacent the hammer 30 and to pump it down through the reflood tube 78. The inlet is preferably arranged to be located away from the path of gas bubbles which may emanate from the hammer so that non-aerated water will be pumped into the reflood passageway. It will also be appreciated that the pump 76 may be mounted at or above the water surface with its outlet connected via a suitable conduit (not shown) extending down to the reflood tube 78.

The electrical cables 38 and the gas pressure supply conduit 36 pass down through the casing cover plate 58 and extend down through the space between the guide tube 46 and the outer casing 56 to the lower end of the hammer. The return conduit 42, should one be employed, opens through the casing cover plate 58 to the interior of the outer casing 56.

The ram 44 is also fitted with a circumferential ram to guide tube sliding seal 82, which when the ram is at rest on the anvil 50, as shown in FIG. 4, is positioned above the guide tube ports 74.

In operation, the hammer 30 is submerged, as shown in FIG. 1, and is lowered to the level of the anchor pile 24 to be driven at the bottom of the tower 10. Air or other gas is trapped inside the outer casing 56 (FIG. 4). This gas becomes compressed therein to the pressure of the surrounding water which acts through the exhaust opening 60. It will be appreciated that the outer casing 56 functions in the manner of a diving bell in that the air or gas trapped inside it prevents water from entering up past the level of the anvil 50. Thus the internal moving portions of the hammer are maintained essentially free of water. When the hammer is first lowered into the water, the air or gas pressure inside the outer casing 56 may not be sufficient to prevent water from entering up into the hammer. However, during operation of the hammer exhaust gas from the discharge device 64 pressurizes the interior of the outer casing 56 and keeps it free of water.

The hammer 30 operates by intermittent triggering of the gas discharge device 64 which, upon each triggering, releases a sudden burst of pressurized gas into the cavity 62 to drive the ram 44 upwardly in the guide tube 46. The ram thereafter falls back down in the tube and strikes the anvil 50 to deliver and impact blow through the anvil and the pile cap block 54 to the pile being driven. After each triggering of the gas discharge device 64 a further charge of pressurized gas is supplied to it from the compressor 40 through the pressurized gas supply conduit 36.

It has been found that the energy of the expanding gas released from the gas discharge device 64 is best transferred to the ram 44 if the cavity 64 is filled, at the time of triggering, with water. Moreover, this water should be as free as possible from entrained air or gas, otherwise a considerable portion of the energy of the expanding gas will be dissipated in compressing the free and dissolved gases present in the cavity 64. On the other hand it is important that the cavity 64 be essentially free of water when the ram 44 descends after each triggering so that the ram will strike the impact face 52 of the anvil 50 directly and not through a layer of water; otherwise a sharp clean blow will not be obtained.

When the ram 44 is at rest on the anvil 50 awaiting triggering of the gas discharge device 64, as shown in FIG. 4, the reflood pump 76 pumps surrounding water down through the reflood tube 66 and out the openings 80 into the reflood passageway 66. This water flows down through the reflood passageway 66 past the valve plate 68 and into the cavity 62 to flood the cavity. Air or other gas from the cavity is vented through the reflood vent passage 72 and out through the guide tube ports 74 to the space between the guide tube 46 and the outer casing 56. This displaced air pushes down against the water level inside the exhaust opening 60.

Figure 6:
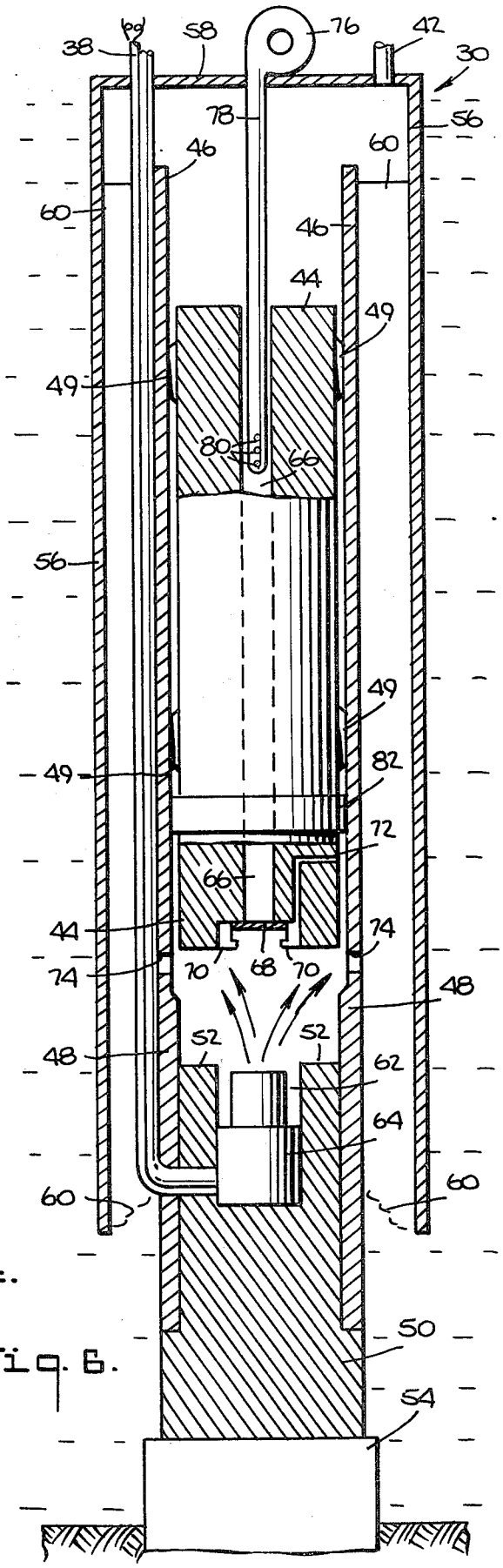
FIGS. 6–8 are views similar to FIG. 4 but showing the hammer at different stages in a cycle of operation.

When the gas discharge device 64 is triggered, as shown in FIG. 6, the resulting blast of pressurized gas forces the reflood valve plate 68 against the bottom of the reflood passageway 66 to close it against further flow. Nearly the entire energy of the expanding gas from the gas discharge device is then directed against the bottom of the ram 44 to drive it upwardly in the guide tube 46.

Shortly after the ram 44 has begun its upward movement, but after most of the driving energy of the released gas from the discharge device 64 has been expanded, the lower end of the ram 44 clears the acceleration sleeve 48 and the guide tube ports 74. When this occurs the water and excess air present in the cavity 62 are driven outwardly through the ports and into the region between the guide tube 46 and the outer casing 56.

Figure 7:
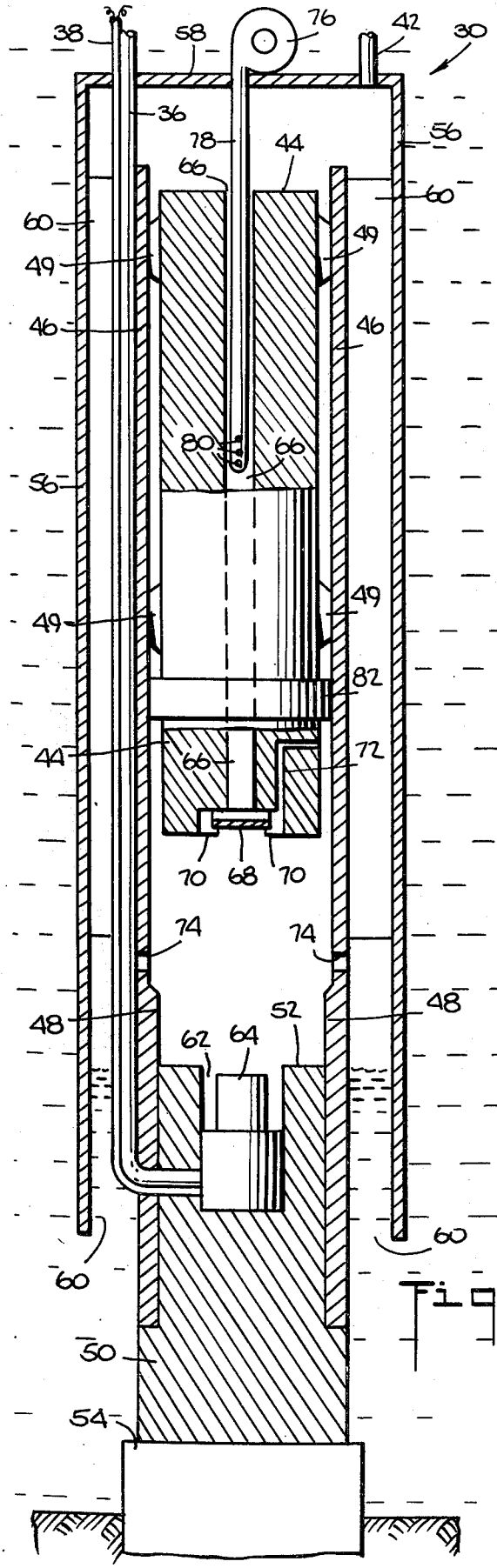

The ram 44 then continues its upward movement in the guide tube 46, as shown in FIG. 7, until the kinetic energy it received from the expanding gas has been dissipated. The ram then falls back down through the guide tube, as shown in FIG. 8, until it strikes the anvil 50 and comes to rest thereon.

Figure 8:
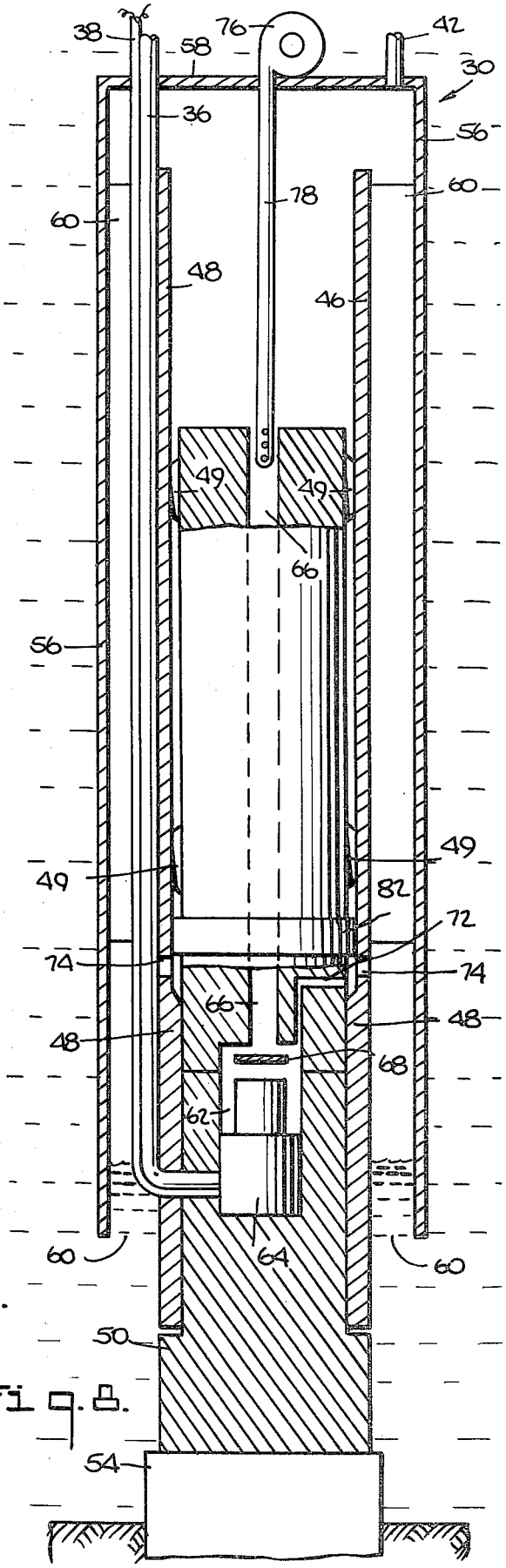

During the up and down movement of the ram 44, as shown in FIGS. 7 and 8, the space between the guide tube 46 and the outer casing 56 is in communication with the region above the ram by virtue of the fact that the upper end of the guide tube 46 is located below the casing cover plate 58. The space between the guide tube and the outer casing is also in communication with the region below the ram via the guide tube ports 74. This allows for free circulation of air or gas displaced by the ram during the major portion of its up and down movement. As a result no vacuum is drawn under the ram during its upward stroke so that the chances of water being drawn in to flood the anvil region prematurely are minimized. Further, during the downward ram stroke no gas becomes trapped under the ram until shortly before it reaches the anvil, i.e. when it reenters the acceleration sleeve 48. Consequently, cushioning by entrapment of gas under the ram is minimized, and a sharp ram to anvil impact is obtained.

When the gas discharge device 64 is triggered and the reflood valve plate 68 closes the reflood passageway 66, the water trapped inside the passageway is driven upwardly as though it were an integral part of the ram 44. After the ram reaches the top of its stroke and begins to fall back downwardly the water in the passageway 66 also falls back downwardly so that it produces no net change on the valve plate and does not cause the plate to open. Thus no reflooding of the cavity 62 takes place due to the water trapped in the reflood passageway 66. During the up and down ram movement, however, the reflood pump 76 does continue operation so that the head of water in the reflood passageway continuously increases. This additional head of water has no effect during the downward stroke of the ram however, since the water and the ram both are subject to the same gravitational downward acceleration. Now during the upward stroke the increased head of water due to pump flow may result in some flow down through the valve plate 68; however, the flow should be minimal because of the relatively short time period and small head increase involved, Further, the rate of pump flow can be adjusted to minimize the accumulation of this head during the upward ram movement. Also it will be noted that the reflood tube outlet openings 80 are arranged laterally of the reflood tube 78. Thus, no downward component of flow energy is produced on the water in the reflood tube 78.

It will also be appreciated that the time at which the water head in the reflood passageway 66 is greatest is after the ram has completed its downward travel and has impacted on the anvil 50. This large head serves to maximize water flow into the cavity 62 after impact and thereby reduce flooding time. Thus a large number of hammer blows can be delivered in a given amount of time.

FIG. 9 shows an arrangement which serves to avoid accumulation of increased water from the reflood tube 78 during the ram upstroke. As shown in FIG. 9 there are provided a pair of upper drain ports 90 in the guide tube near the upper end of the ram 44 when it is at rest on the anvil 50. In this embodiment the reflood pump 76 is deliberately operated to deliver an excess amount of water to the reflood passageway 66 so that the entire reflood passageway becomes filled to overflowing during the time between each ram to anvil impact and the next succeeding triggering of the gas discharge device 64. When the reflood passageway 66 becomes filled to overflowing the excess water spills out through the ports 90 into the outer casing 56. Thus the head of water in the reflood passageway of the ram is limited to the height of the ram and is not increased by the continued flow of reflood water during upward ram movement. The size of the ports 90 and the clearance between the ram and the guide tube 46 should, of course, be large enough to allow free flow of this excess water.

It will be noted that as the ram 44 moves upwardly the reflood tube 78 will displace water from the reflood passageway as more and more of the tube 78 enters into the passageway. This should have minimal effect on the reflood valve 68 however so long as the overflow passageways, including the ports 90 are sufficiently large to accommodate this flow.

FIG. 10 shows a modification including transverse passages 92 in the ram 44 at a level below the top of the ram. These ports are located at a level above the reflood valve 68 to provide a desired head of water in the reflood passageway 66. Excess pump flow will be drained off at the level of and through the transverse passages and the ports 92. Thus it may be possible to utilize an arrangement in which a closely controlled head of water is always present above the valve 66 without appreciable effects being produced by the displacement of the reflood tube 78 into the reflood passageway 66 during upward ram movement.

As can be seen from the foregoing the present invention provides an arrangement wherein a pile driving hammer ram is driven up and down in an air or gas environment even though the hammer is submerged at considerable depth. This arrangement moreover makes use of a diving bell principle and accordingly avoids the necessity for special seals and complex arrangements to keep sea water out of the system.

The arrangements of the present invention moreover provide a cavity reflood arrangement for a gas discharge device wherein reflood water is supplied down a stationary reflood tube and passes from there into a longitudinal reflood passageway in the ram itself. The ram moves up and down in the guide tube and this movement is accommodated by the telescoping relationship of the reflood tube 78 and the reflood passageway 66.

The present invention also provides a positive reflood water supply to the cavity 62 surrounding the gas discharge device 64 so that the cavity is reflooded very quickly during each cycle of hammer operation. Also the pump 76 may be arranged such that its intake is located away from any aerated water that may result from the hammering operation. In this connection it will be noted that following each burst from the gas discharge device 64 the water from the cavity 62 is driven, along with excess gas, out through the ports 74 and into the outer casing 56. This water and gas produce a displacement in the lower region of the outer casing; and if enough gas is discharged the water level will be driven down until excess gas will vent out through the exhaust opening 60 and rise up around the hammer in the form of bubbles. The water in the vicinity of these bubbles is aerated to a greater extent than the water further distant from these bubbles. Aerated water is undesirable for use in reflooding the cavity 62 since it contains a percentage of gas which is compressible and therefore a portion of the discharge energy is dissipated in compressing of this gas. The reflood arrangement of the present invention overcomes this difficulty by providing a positive reflood pumping system wherein a reflood pump is arranged with its intake located at any position remote from the exhaust opening 60 so that aerated water is not used to fill the cavity 62.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by Letters Patent is:

1. A submersible hammer comprising a vertical guide tube open at its upper and lower ends, a massive ram fitted inside said guide tube for up and down movement therein, an anvil located at the bottom of the guide tube in the path of downward movement of said ram and having an impact surface to be struck by said ram, a gas discharge device operable to release a sudden burst of high pressure gas into a cavity defined by and between said ram and anvil to drive the ram upwardly in the guide tube, said guide tube being formed with openings a finite distance above said anvil at a location such that said openings are sealed off from said cavity by the side of said ram when it is at rest on said anvil and such that they become unsealed during upward movement of said ram following operation of said gas discharge device and an outer casing surrounding and extending over said guide tube to entrap gas therein in the manner of a diving bell, said outer casing being open at a location below the impact surface of said anvil and the region of said guide tube above said ram being in communication with the space between said guide tube and said outer casing.

2. A submersible hammer according to claim 1 wherein said hammer further includes water supply means for pumping water into said cavity to fill same when said ram is resting on said anvil.

3. A submersible hammer according to claim 1 wherein said guide tube is formed internally with an acceleration sleeve which fits closely but loosely around the lower portions of said ram as it rests on said anvil, said openings being formed above said acceleration sleeve.

4. A submersible hammer comprising an outer casing closed at its upper end and open at its lower end to entrap gas therein while said casing is submerged in a body of water, an anvil supported in said outer casing near its lower end, a massive ram, means for guiding said ram for up and down movement inside said outer casing to impact upon said anvil and drive it downwardly, a pressurized gas discharge device positioned in a cavity defined by and between said ram and anvil with the ram resting on said anvil, said gas discharge gas being triggerable to release a sudden burst of high pressure gas into said cavity for driving said ram upwardly in said casing and water supply means for pumping water into said cavity to fill same when said ram is resting on said anvil said means for guiding said ram for up and down movement inside said outer casing being in open communication with the interior of said outer casing above said ram.

5. A submersible hammer according to claim 4 wherein said ram has a reflood passage extending longitudinally through the ram from its upper end to said cavity, a water supply tube extending down from the top of the outer casing and opening into said reflood passage, pumping means arranged for pumping water from outside said casing into said reflood passageway for reflooding said cavity between successive operation of said gas discharge device.

6. A submersible hammer according to claim 4 wherein said reflood passage is provided with a valve arranged to permit downward flow of water therethrough but to prevent upward flow of water therethrough.

7. A submersible hammer according to claim 5 wherein said pumping means includes a reflood tube extending down inside said outer casing and terminating and opening inside said reflood passage, whereby said reflood tube remains stationary and continues to open into said reflood passage while said ram moves up and down.

8. A submersible hammer according to claim 7 wherein said reflood tube has laterally extending openings for supplying water to said reflood passage without any downward velocity component.

9. A submersible hammer according to claim 7 wherein the length of said reflood tube is sufficient to extend into said reflood passage when said ram is in its lowermost position resting on said anvil.

10. A submersible hammer according to claim 5 wherein said pumping means includes an inlet positioned near the level of said hammer at a location to take in non-aerated water.

11. A submersible hammer according to claim 5 wherein said ram is guided for up and down movement in a guide tube located in said outer casing said guide tube having drain openings located up from the bottom of said ram to permit discharge of excess water from said reflood passage into said outer casing.

12. A submersible hammer according to claim 11 wherein said ram is provided with transverse passageways extending laterally from said reflood passageway and communicating with said drain openings.

13. A method of driving a pile underwater, said method comprising the steps of driving of a ram upwardly from the pile by suddenly releasing a charge of pressurized gas into the region under the ram, then allowing the ram to fall back toward the pile to drive it downwardly, collecting the exhausted charge of pressurized gas following its driving of the ram; entrapping the exhausted gas in a casing surrounding the ram and closed at its upper end and open below said ram to pressurize the interior of the casing and maintain the region surrounding the ram free of water during operation of the hammer and directing the gas displaced by upward ram movement through the outer casing and back into the region under the ram to prevent the occurrence of a vacuum which might otherwise prematurely draw water into the space under the ram prior to ram impact.

14. A method according to claim 13 further including the step of flooding the region under the ram following impact.

15. A method according to claim 14 wherein said flooding is carried out by pumping water into said region.

* * * * *

UNITED STATES PATENT AND TRADEMARK OFFICE

CERTIFICATE OF CORRECTION

PATENT NO. : 4,126,191

DATED : November 21, 1978

INVENTOR(S) : George J. Gendron and Henry A. Nelson Holland

It is certified that error appears in the above-identified patent and that said Letters Patent are hereby corrected as shown below:

Column 6, line 22, "66" to read -- 78 --;

Column 6, lines 41 and 42, the word "expanded" to read

-- expended --.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*